United States Patent [19]

Capdeboscq et al.

[11] Patent Number: 4,494,602

[45] Date of Patent: Jan. 22, 1985

[54] ELECTRICAL CONNECTION DEVICE FOR AN UNDERWATER WELL HEAD

[75] Inventors: André Capdeboscq, Jurancon; Jean-Claude Ferry, Haget Aubin, both of France

[73] Assignee: Societe Nationale Elf Aquitaine (Production), Courbevoie, France

[21] Appl. No.: 456,995

[22] Filed: Jan. 10, 1983

[30] Foreign Application Priority Data

Jan. 14, 1982 [FR] France ..... 82 00522

[51] Int. Cl.[3] ..... E21B 33/035

[52] U.S. Cl. ..... 166/65 R; 339/16 R; 339/117 R

[58] Field of Search ..... 166/65 R, 363, 368, 166/344; 339/16 R, 16 RC, 15, 117 R

[56] References Cited

U.S. PATENT DOCUMENTS

| | | | |
|---|---|---|---|
| 3,378,811 | 4/1968 | Cullen et al. | 339/117 R |
| 3,398,392 | 8/1968 | Henderson | 339/117 R |
| 3,839,608 | 10/1974 | DeVries | 339/117 R |
| 3,926,269 | 12/1975 | Cullen et al. | 166/65 R |
| 3,972,581 | 8/1976 | Oldham | 339/117 R |
| 4,003,428 | 1/1977 | Zehren | 166/65 R |
| 4,117,287 | 9/1978 | Walker et al. | 200/82 R |
| 4,363,168 | 12/1982 | Bryer et al. | 166/65 R |
| 4,390,229 | 6/1983 | Chevalier | 339/117 R |

*Primary Examiner*—James A. Leppink
*Assistant Examiner*—Hoang C. Dang
*Attorney, Agent, or Firm*—Poms, Smith, Lande & Rose

[57] ABSTRACT

Electric connector for use with underwater well head. This device comprises a coaxial cylindrical male element 20 of the suspension connector 3 of the tubing 15 in the well head 2, fixed to the suspension connector 3 by a ring element 23 bored by at least one passage 24 for the effluent and bearing on its cylindrical outline three metallic ring contacts 25, 26, 27 connected through the body of the male element 20 and the connector to the conductors of a cable 19 leading to a motor 16 and a female element 21 in the form of a cylindrical bell adapted to slide along the male element 20 and bearing three electric contacts 28, 29, 30 corresponding to the contacts of the male element 20, these contacts being connected to an electric power supply, a delivery pipe 31 for neutral gas issuing at the bottom of the cylindrical bell 22.

Such a connector is adapted to supply the offshore deep well pumps with electric power.

4 Claims, 4 Drawing Figures

ELECTRICAL CONNECTION DEVICE FOR AN UNDERWATER WELL HEAD

BACKGROUND OF THE INVENTION

The present invention concerns a device for ensuring the continuity of an electrical circuit, from a surface installation to the electric motor of the centrifugal pump positioned offshore at the bottom of the well and this through the intermediary of a well head installed on the seabed.

The technique of submarine well heads allowing an eruptive effluent to be produced, and recovered on the surface is already known. Present conditions require that marginal deposits be developed, either because they are not eruptive, or because the characteristics of the reservoir are such that it only supplies an appreciable production if lifting energy is applied. In both cases it is necessary either to lighten the liquid column by injecting gas close to the level of production, or to use pumping means.

Extraction by immersed electric centrifugal pump allows considerable output, which is much sought after in under-water production, but it presents difficulties for the sealed connection of the electric conductors at the well head level.

SUMMARY OF THE INVENTION

The present invention allows these difficulties to be overcome by the use of a connector for which the relative position of the male and female elements associated to the injection of a neutral gas in the connection zone causes the elimination of any excess pressure at the engagement and removes all trace of liquid in this zone.

An electrical connection device according to the invention in an underwater well head for supplying a motor 16 driving a deep well pump 17 is characterized in that it comprises a coaxial cylindrical male element 20 of the suspension connector 3 of the tubing 15 in the well head 2, this male element 20 being fixed to the suspension connector 3 by a ring element 23 bored by at least one opening 24 for the passage of the effluent and having on its cylindrical outline a plurality of spaced annular electric contacts 25, . . . , connected by the insulated electric conductors through the body of the male element 20 and the suspension connector 3 to the conductors of a cable 19 leading to the electric motor 16 driving the deep well pump 17 and a female element 21 in the shape of a cylindrical bell 22 adapted to slide along the male element 20 and comprising a plurality of electric contacts 28, . . . adapted to rest on the annular insulated electric contacts 25, . . . of the male element 20, these contacts 28 being connected by insulated electric conductors, housed in the body of the female element 21 and thereafter of an extension element 9 of this female element 21, at the end of an electric cable leading to an electric power supply, this extension element 9 being provided in its body with a pipe 31 connecting an opening 32 by which it issues at the bottom 33 of the cylindrical bell 22 of the female element 21 to a pipe-line leading to a neutral gas supply under controlled pressure.

According to a preferred embodiment, the female element 21 comprises at the level of the bottom of the bell 22 an extra thickness in the shape of an annular ring 34 adapted to slide inside the suspension connector 3 of the tubing, this extra thickness 34 being bored by at least one orifice 35 for passage of the effluent.

In the different embodiments, the female element 21 on either side of the group of electric contacts 28, . . . is provided with rings 36 and 37 for sealing with the male part 20.

In the different embodiments, in order to allow the passage of the hydraulic pipes, through the well heads, and their connection at this level, the annular extra thickness 34 comprises a bore hole 39 for a pipe 38 extending to the end of the extension element 9 to be connected to a hydraulic pipe 11, this pipe 38 being connectable in a sealed manner with the orifice 40 of a pipe 41 provided in the annular body of the suspension connector 3 of the tubing 15 and followed by a hydraulic pipe 42 annexed to the tubing 15.

In various embodiments of the invention, the opening 46 through which issues the cylindrical bell 22 of the female element 21 is provided with a membrane 47 adapted to be penetrated by the male element 20.

According to another characteristic of the invention, said invention facilitates the use of flexible tubing in the wall of which the electrical conductors can be immersed.

BRIEF DESCRIPTION OF THE DRAWINGS

Other characteristics of the invention will become apparent after reading through the description of an embodiment of the invention, by way of non-limitative illustration, with the use of the following drawings.

DESCRIPTION OF THE PREFERRED EMBODIMENTS

Figure 1:
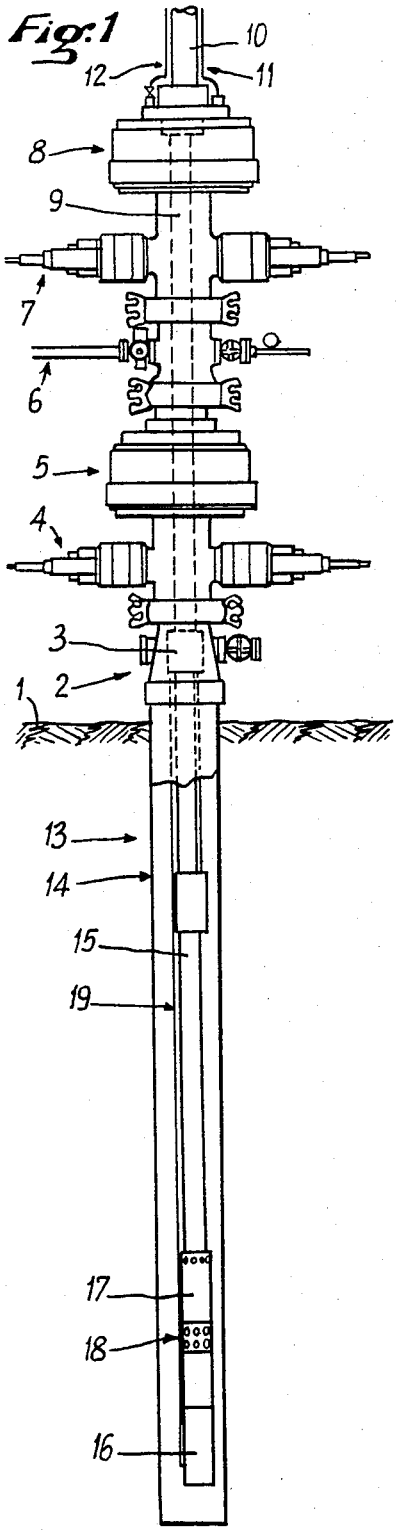
FIG. 1: diagram of a well assembly equipped with an electric deep well pump.

The electrical connection device is constituted by elements of the suspension connector 3 adapted to this function. This suspension connector 3 is extended towards the top by an extension element 9, the cylindrical external outline of which has a diameter clearly smaller than the internal diameter of the interior passage of the lower 4 and upper 7 stop-valve devices, as well as the lower 5 and upper 8 hydraulic connectors and the production connector 6. This extension element contains different electric hydraulic and gas under pressure pipe-lines, converging, on the one hand, at the suspension connector 3 and, on the other hand, at connections located at the upper end of this connection element 9 so that these connections are located above the upper hydraulic connector 8. From these connections, on the upper end of element 9, are shown an electric cable 10, a hydraulic control line 11 and an injection line of a neutral gas 12.

In order that the connections with these different cables and lines be located above the upper hydraulic connector 8 and provided with means for ensuring the perfect sealing of the internal ring-shaped space of the said hydraulic connector 8 with the external medium, it is necessary that the element 9 be composed of a basic element **9*a* integral with the connector 3 and the extension, and of a plurality of elements such as 9*b*, 9*c***, . . . stacked and hermetically integral, so that the height of the assembly is adjusted to the height of the pile of the devices 4,5,6,7.

This extension element 9 being sealed, on the one hand, it insulates the cables and lines that it contains with respect to the external medium and, on the other hand, it allows the closing of the jaws of the upper stop-valve 7 on its external outline.

The jaws of the lower stop-valve 4 are adapted to ensure a sealed closing after withdrawal towards the top of the retractable part of the connector 3.

The well head 2 rises above a well 13 delimited by a casing 14 cemented and perforated at the place of the production level (not shown).

The suspension connector 3 is connected by a thread pitch to a column to the tubing 15 at the lower end of which is an electric motor driving a pump 17, the motor 16 being separated from the pump 17 by a suction strainer 18.

The three-phase electric cable 10 extends from the platform situated above the surface of the sea to the connection device located in the suspension connector 3, thereafter it is extended to the motor 16 by an electric cable 19, fixed by means of collars to the outside of the tubing 15.

In other embodiments, not shown, the electric cable 19 is located in the thickness of the sheath of a flexible tube similar to that used for flexi-drilling.

Figure 2:
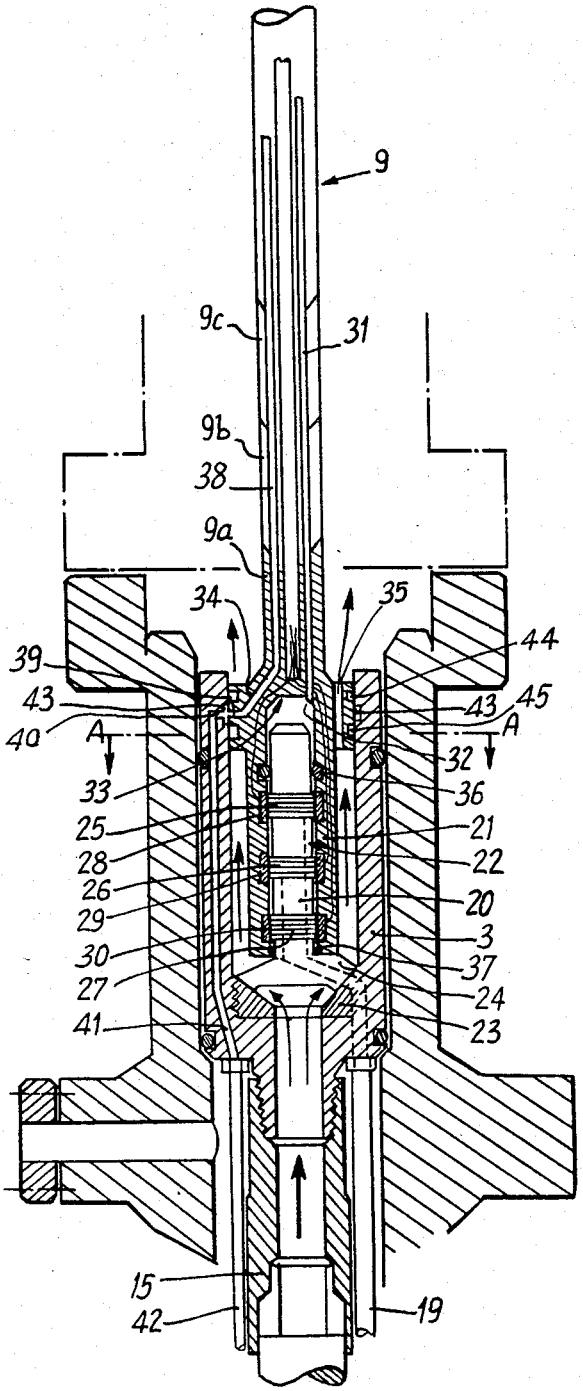
FIG. 2: diagram of the through-crossing of a well head by electrical conductors with the use of a connection device.

FIG. 2 is a diagram of the through-crossing of a well head by electric conductors by means of a connection device.

Such a connection device comprises a coaxial cylindrical full male element 20 of the suspension connector 3 of the tubing 15 in the well head 2 and a female element 21 delimiting a cylindrical element 20.

The male element 20 is fixed to the suspension connector 3 by an annular ring 23 bored by three openings 24 for the passage of the effluent and bears on its cylindrical outline three annular spaced electric contacts 25, 26, 27. These contacts are connected by insulated electric conductors through the body of the male element 20 and of the suspension connector 3 to the conductors of a cable 19 leading to the electric motor 16 driving the deep well pump.

The female element 21 has the shape of a cylindrical bell having an internal diameter slightly larger than the external diameter of the male cylindrical element 20, and it comprises three annular elastic electric contacts 28, 29, 30 adapted to bear on the corresponding annular electric contacts 25, 26, 27 of the male element 20 having the same intervals. These contacts 28, 29, 30 are connected by insulated electric conductors, not shown, housed in the body of the female element 21 and thereafter in a rod 9 as a coaxial extension element of the female element 21, at the end of an electric cable leading to the terminals of an electric power supply, not shown.

This extension element 9 is provided in its body with a pipe 31 connecting an opening 32 by which it issues at the bottom 33 of the cylindrical bell to a pipe-line leading to a supply of neutral gas under pressure, not shown.

The female element 21 is provided at the level of the bottom 33 of the bell with an extra thickness in the form of an annular ring 34 having a cylindrical external outline and adapted to slide inside the suspension connector 3 of the tubing, this extra thickness in the form of an annular ring 34 comprising three orifices such as 35 for the passage of the effluent.

The female element 21 comprises on either side of the group of electric contacts 28, 29, 30 sealing rings 36 and 37 contacting with the male element 20.

The extra thickness 34 comprises, in its body, a hole for a pipe 38 extending, on the one hand, to the end of the extension element 9 where it is connected to a hydraulic pipe 11 shown on FIG. 1 and, on the other hand, to an orifice 39 which may be sealingly connected with the orifice 40 of a pipe 41 provided in the annular body of the suspension connector 3 and followed by a hydraulic pipe 42, fixed by means of collars along the tubing 15, up to a closing mechanism, not shown, which is actuated by the hydraulic fluid.

The orifice 40 of the pipe 41 is located in an annular groove 43 cut into the cylindrical internal outline of the connector 3. The extra thickness 34 comprises on either side of the orifice 39 sealing elements 44 and 45 for sealing the connection between the orifices 39 and 40, whatever the positioning of the male element 20 with respect to the female element 21.

Figure 3:
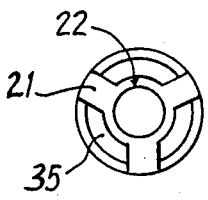
FIG. 3: a section along line AA of FIG. 2.

FIG. 3 shows a section, along line AA of FIG. 2, of the female element 21. This figure illustrates the orifices 35 for the passage of the effluent and the circular section of the cylindrical bell 22 inside which slides the cylindrical male element 20.

Figure 4:
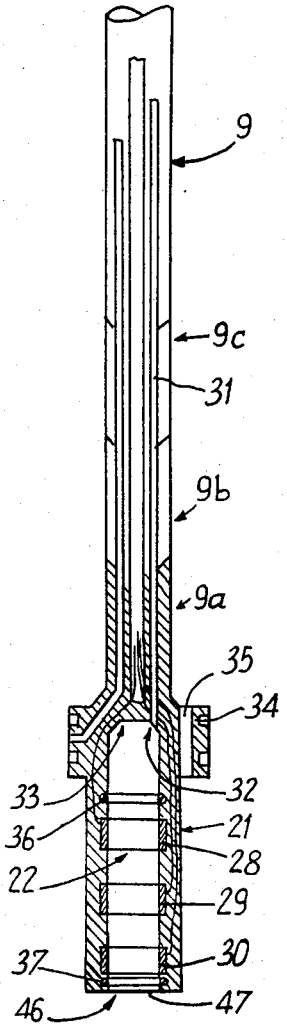
FIG. 4: diagram of the female element of the connection device.

FIG. 4 shows the diagram of the female element 21 of the connection device, this female element 21 being insulated so that it is positioned before the connection.

This female element 21 delimits a cylindrical bell 22 on the internal outline of which are located three annular contacts 28, 29 and 30 enclosed within sealing rings 36 and 37.

FIG. 4 shows at the bottom 33 of the bell 22 the annular extra thickness 34 with a cylindrical external outline, this extra thickness 34 comprising three orifices 35 for the passage of the effluent.

The cylindrical bell issues towards the bottom through an opening 46 provided with a protective membrane 47 adapted to be penetrated by the male element 20.

POSITIONING OF THE CONNECTION

The male element 20 is positioned in the suspension connector 3 of the tubing in the well head.

The lowering of the female element 21 is carried out, the cylindrical bell 22 being filled with inert gas, the pressure of which is adjusted continuously, and insulated from the ambient medium, i.e. completion fluid, by a frangible membrane 47.

The lowering of the female element 21 is carried out, whatever its positioning. No positioning nor marking is prescribed for connecting the two elements 20 and 21.

When the male element penetrates the bell 22, it breaks the membrane 47 and immediately the pressure supply by pipe 31 concurrently with the lower sealing ring 37 have a cooperating effect so as to prevent any pollution of the electric contacts 28, 29 and 30 by the ambient medium.

Element 20 slides inside the bell 22 until the electric contact is made. When this position is reached, the presentation and connection of the hydraulic lines 38 and 42 are also achieved.

Once the connection is obtained, it is possible, at any moment, to close the upper stop-valve 7 since its jaws have an outline adapted to close on the external outline of the extension element 9. After disconnection, when the female element 21 has been sufficiently raised, the lower stop-valve 4 can be actuated and thus ensures the complete closing down of the well head.

This device ensures in the best sealing and insulating conditions, the connection of the transfer lines of electric force, especially for supplying a motor driving a deep well pump. Such a device can also be used for supplying electric power to any motor associated to a well head and possibly located on a production or treatment installation situated offshore on the sea bed.

We claim:

1. An electrical connection device for an underwater wellhead including upper and lower stop-valve devices, hydraulic and production connectors, and supplying a motor driving a deep well pump suspended by tubing from the wellhead, the provision of:

a suspension connector attached to said tubing beneath the lower stop-valve device and in communication with said tubing, said connector having a cylindrical wall with a top open end and a bottom end having a threaded connection to said tubing;

a male element coaxial with said cylindrical wall, and having a lower end seated in said bottom end of the connector and having a passageway for effluent from said tubing, said male element being provided with axially spaced annular contacts having leads adapted to be connected to said motor;

a female element having an elongated bell shaped hollow body forming an internal chamber provided with axially spaced internal electrical contacts, said body coaxially receiving said male element in said chamber for mutual engagement of the electrical contacts thereon, said body having an outer diameter for a major portion of its length less than the inner diameter of the cylindrical wall of the suspension connector to provide an annular space for passage of effluent through the lower end of the male element from the tubing, said female element having an enlarged portion sealingly engaged with internal surfaces of the top portion of the cylindrical wall of the suspension connector, said enlarged portion having openings therein for passage therethrough of effluent, said female element having an extension portion extending through and above the said stop-valve devices, hydraulic and production connectors associated with said wellhead, said extension portion providing a cylindrical surface against which at least one of said stop-valve devices may seal while communication is maintained with said motor, pump, and suspension connector.

2. An electrical connection device as stated in claim 1 including a membrane covering the bottom end of said chamber in the bell shaped hollow body;

said extension portion having an internal passageway in communication with the upper portion of said chamber for injection of inert gas under pressure to prevent flow of effluent into said chamber when said male element pierces said membrane during making of the electrical connection.

3. A device as stated in claim 2 including seal rings carried in said chamber above and below the electrical contacts to seal said contacts from effluent after the electrical connection is made.

4. A device as stated in claim 1 wherein said cylindrical wall of said suspension connector is provided with a passageway for communication with the hydraulic system;

said extension portion having a passageway in communication with said passageway in said cylindrical wall in assembled relation of the male and female elements.

* * * * *